United States Patent [19]

Roess

[11] Patent Number: 4,860,407

[45] Date of Patent: Aug. 29, 1989

[54] DEVICE FOR THE BLENDING OF DIFFERENT FIBRES IN A DESIRED RATIO OF COMPONENTS

[76] Inventor: Hans Roess, Bernhardstrasse 24, 2832 Twistringen, Fed. Rep. of Germany

[21] Appl. No.: 160,361

[22] Filed: Feb. 25, 1988

[30] Foreign Application Priority Data

Feb. 25, 1987 [DE] Fed. Rep. of Germany ..... 3706008

[51] Int. Cl.[4] ..... D01G 13/00

[52] U.S. Cl. ..... 19/145.5

[58] Field of Search ..... 19/145.5, 145.7

[56] References Cited

U.S. PATENT DOCUMENTS

| | | | |
|---|---|---|---|
| 2,816,327 | 12/1957 | Hunter et al. | 19/145.5 |
| 3,107,397 | 10/1963 | Hilt et al. | 19/145.5 |
| 3,648,330 | 3/1972 | Binder et al. | 19/145.5 |
| 4,103,398 | 8/1978 | Rhyne et al. | 19/145.5 |
| 4,531,262 | 7/1985 | Reiche | 19/145.5 |

FOREIGN PATENT DOCUMENTS

| | | | |
|---|---|---|---|
| 1091011 | 10/1960 | France . | |
| 1815341 | 6/1970 | France . | |
| 0806790 | 2/1981 | U.S.S.R. | 19/145.5 |

*Primary Examiner*—Werner H. Schroeder
*Assistant Examiner*—Douglas E. Price
*Attorney, Agent, or Firm*—Kinney & Lange

[57] ABSTRACT

A device for blending different fibres in a desired ratio to make envelopes for drain pipes has at least two pressure passages in a parallel relation, with a small space therebetween. Different fibres are introduced into the first ends of each pressure passage by a conveying fan outlet, and the fibres so introduced build up in each pressure passage into material columns of homogeneously compressed fibres. Each pressure passage has at least one exit port for venting pressurized air in front of its column. Conveyors are provided at the second ends of the pressure passages to feed the compressed fibres into a longitudinal opening in one side of a stationary drum which extends over the width of the second ends of the pressure passages. A pin-feed drum is rotatably arranged within the stationary drum and is driven to convey the compressed fibres to a common suction passage on the other side of the stationary drum, which in turn is connected to a suction tube.

4 Claims, 2 Drawing Sheets

DEVICE FOR THE BLENDING OF DIFFERENT FIBRES IN A DESIRED RATIO OF COMPONENTS

BACKGROUND OF THE INVENTION

1. Field of the Invention

The invention relates to a device for the blending of different fibres in a desired ratio of components, especially for the production of envelopes for drain pipes.

2. Description of Prior Art

It is known, to use different kind of fibres for envelopes of drain pipes, for example straw, coconut fibres, polypropylene fibres or such like. According to the sort of soil a desired fibre is used. As known straw rots relatively quickly. Coconut fibres rot too, but this takes a longer time. Polypropylene fibres do not rot at all. In this connection it is also known to build up an envelope layer of underlayers of different fibres, to obtain desired filter properties.

SUMMARY OF THE INVENTION

It is the object of the invention to produce a device, by which different fibres may be blended together in an accurately adjustable ratio of components.

This object is attained by the characteristics given in claim 1.

The device according to the invention comprises at least two parallel pressure passages arranged side by side with a small distance therebetween. In case more than two fibre components are to be blended, the number of pressure passages can be increased. The inlet of the pressure passages is connected to a conveying fan which forces the respective fibre component into the pressure passage. In the pressure passage the material is homogeneously compressed. Conveyor means are arranged at the outlet of the pressure passages, which are driven by a continuously variable drive. The extremities of the Conveyor means are associated with a continuous longitudinal opening of a drum, in which a pin-feed drum is arranged. Consequently, the pin-feed or blend drum receives the material from the pressure passages at the same time. The drum is joined to a common suction passage, which is connected to the suction tube of an extractor fan. By the extractor fan the blended material is carried out and for instance conveyed to a machine of known construction for the production of envelopes for drain pipes.

The adjustment of the ratio of components of two components is done by the respective controlling of the conveyor means. Surprisingly, it turned out that an exact ratio of components can be obtained over a broad blending range by these simple means. Further, it turned out surprisingly that the very simple device comprising common pin-feed drums in one drum is sufficient to produce a completely homogeneous blending of the individual fibres.

The expense in equipment of the device according to the invention is extremely small. The device can be operated completely automatic. An almost undisturbed operation over a longer period is possible due to the fact that almost no wearable parts are included.

It is known from textile processing to blend fibres of different proveniences proportionately. In this processing the single components are first weighed out to obtain the desired ratio of components. Then they are delivered to a common passage or tube, in which the blending is done by the entry of turbulent air or similar means.

One embodiment of the invention provides that the conveyor means comprise two spaced conveyor belts, with their tight strands converging in conveying direction. The narrowing slot betwen the conveying belts is directed to the slot formed by two pairs of drawing-up rolls, which in a further embodiment of the invention together extend over the length of the drum. As mentioned above, the speed of the conveying belts is changeable to control the conveyed quantity. Also the drive for the drawing-up rolls respectively the pin-feed drum can be chosen continuously variable.

As mentioned above, the drum containing the pin-feed drum is connected to a common suction passage. In a further embodiment of the invention, this suction passage is tapered towards the suction tube, especially in a cup-like form. Such a formation also contributes to an intensive blending.

The device according to the invention is suitable especially for the production of fibre blending for envelopes of drain pipes. For instance different synthetic fibres can be blended together, but also synthetic fibres with natural fibres, for instance coconut fibres with natural fibres like straw. The device according to the invention is formed out in a manner that it can be connected in series to a machine for the production of envelopes for drain pipes, that means the extractor fan conveys directly into a box feeder or such like, by which a fibre fleece is produced for the enveloping of drain pipes.

BRIEF DESCRIPTION OF THE DRAWINGS

In the following the invention will be explained in more detail along accompanied drawings.

DETAILED DESCRIPTION OF THE PREFERRED EMBODIMENTS

Before coming to the details shown in the figures, it shall be premised, that each of the described characteristics for itself or in combination with characteristics of the claims is of essential inventive significance.

Figure 1:
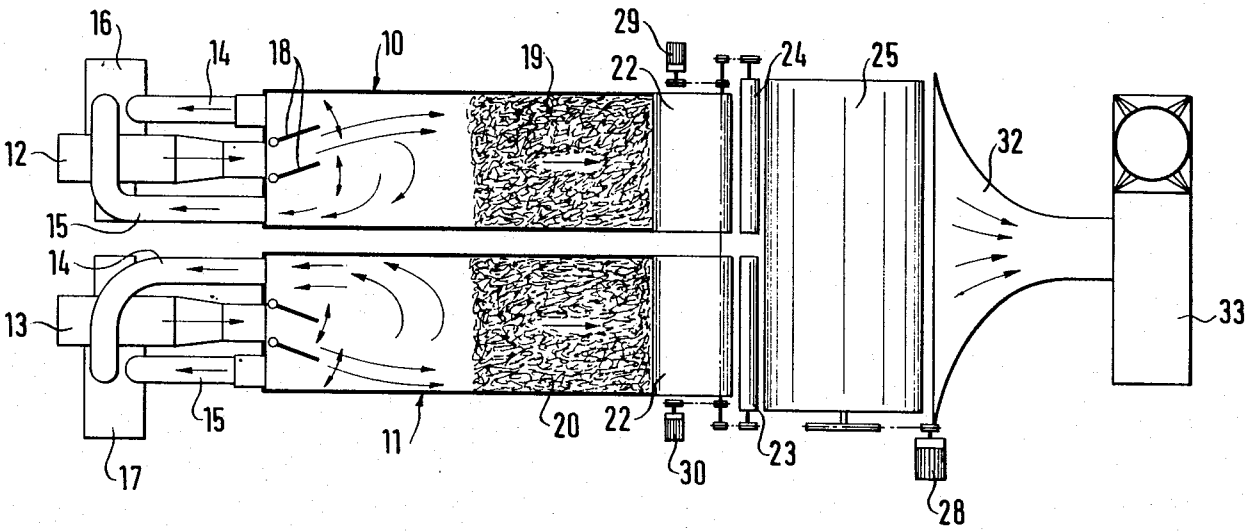
FIG. 1 shows diagramatically the plane view of the device according to the invention.

FIG. 1 shows two pressure passages 10, 11 having the form of flat lying boxes. The left end of pressure passage 10 is connected to a fan 12, the pressure passage 11 is connected to a fan 13. On both sides of the connecting pipe between fans 12 and 13, a pipe 14 respectively 15 for the exhausted air is provided, which leads to a suction pan 16 respectively 17 of the fan 12, 13. The interior of the pressure passage 10 respectively 11 is provided with swivel mounted flaps, which move in a swinging oscillating motion. By the fans 12, 13, different fibres are carried in, which form in the passages 10, 11 material columns 19 respectively 20. The material is compressed relatively homogeneous in the columns 19, 20.

In the final area of the passages 10, 11 conveying means are placed. They comprise a lower conveying belt 21 and an upper conveying belt 22 with the first having a tight strand approximately in the plane of the lower wall of the passage 11, while the other conveying belt extends from the upper wall gradually towards the lower conveying belt 21. The outlet slot between the conveying belts 21, 22 corresponds in its width approximately to the slot between the two pairs of drawing-up rolls 23, 24 situated near to the outlet of the conveying belts 21, 22. The pairs of drawing-up rolls 23, 24 are located in an elongated opening of a drum 25, in which a pin-feed drum 26 is arranged. The drum 26 can be driven by an engine 28 by means of a belt- or chain drive. The pairs of drawing-up rolls 23, 24 are driven by engines 29 respectively 30, which also drive the conveying belts 21, 22. The engines 28 to 30 are continuously variable in their rate of revolutions.

The drum 25 is provided with an outlet slot 31, which is located at the side opposed to the drawing-up rolls and extends over the length of the drum. A suction passage 32 is joined to the outlet slot 31. As can be seen in FIG. 1, the suction passage tapers in a cup-like form. The suction passage leads to an extractor fan 33, by which the material is conveyed to a vertical exit pipe 34.

The described device operates in the following manner. By means of the fans 12, 13, different fibre material is carried into the passages 10, 11, for instance coconut fibres into passage 10 and polypropylene fibres into passage 11. A not described device controls the lengths of the columns 19, 20 with the aim to prevent a delivery of too much material. The stowed air flows back to the suction pan of the fans 12, 13 through the pipes 14, 15. The engines 29, 30 are driven in a manner, that a predetermined quantity of the fibre material is conveyed to the slot of the pairs of drawings-up rolls from the columns 19, 20. Especially the ratio of the speed of the conveying belts 21, 22 and the rate of revolutions of the pairs of drawing-up rolls to another is adjusted, which determine the ratio of components. The fibre material enters the blending drum 25 by passing the pairs of drawing-up rolls 23, 24 in the desired ratio of components and is transported to the suction passage 32, from which it is extracted homogeneously blended and in the correct ratio of components by the fan 33 and pressed into the pipe 34. The pipe 34 may lead to a known machine for the production of envelope for drain pipes.

Figure 2:
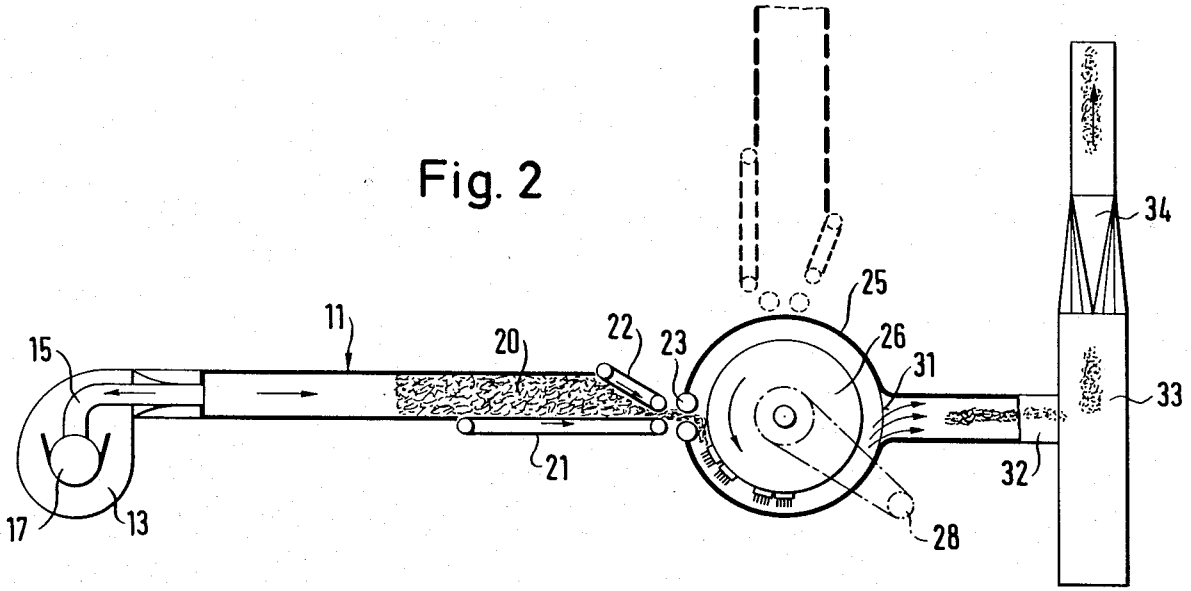
FIG. 2 shows a side view of the device according to FIG. 1.

The location of the passages 10, 11 in the Figures is horizontal. It may also take a vertical position as is shown by the dashed lines in FIG. 2, or any other angular position.

I claim:

1. A device for the blending of different fibres in a desired ratio of components, especially for the production of envelopes for drain pipes, wherein at least two pressure passages are arranged in parallel side by side and with a small distance therebetween, the entrance of the pressure passages each being joined to the outlet of a separate conveying fan for one fibre component, the interior space of the pressure passages being provided with at least one air exit port for the venting of the pressurized air in front of the material column of homogeneously compressed fibres built up in the pressure passages, the rear area of each of the pressure passages being associated with a separate conveyor means driven by a continuously variable drive, a distal end of the conveyor means facing the longitudinal opening of a drum housing, which extends over the total width of the passages, a beater being arranged within the housing for rotation therein and a common suction passage including a suction fan, being connected to the housing opposite the pressure passages.

2. A device according to claim 1, characterized in that the conveyor means comprises two spaced conveying belts, with their facing surfaces converging in the direction of conveyance.

3. A device according to claim 1, characterized in that two aligned pairs of rolls are arranged in the longitudinal opening of the drum the combined pair of rolls extending over the length of the drum.

4. A device according to claim 1, characterized in that the suction passage tapers towards the suction tube preferably in a bell-shaped manner.

* * * * *